US005848788A

United States Patent [19]

Hess

[11] Patent Number: 5,848,788

[45] **Date of Patent: *Dec. 15, 1998**

[54] ELECTRO-MAGNETIC GAME BOARD

[75] Inventor: Richard Hess, Robbinsdale, Minn.

[73] Assignee: H&S&K Enterprises, Robbinsdale, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 712,368

[22] Filed: Sep. 11, 1996

[51] Int. Cl.[6] ..... A63F 3/00

[52] U.S. Cl. ..... 273/239; 273/260

[58] Field of Search ..... 273/239, 260, 273/261

[56] References Cited

U.S. PATENT DOCUMENTS

| | | | |
|---|---|---|---|
| 2,472,916 | 6/1949 | Moon | 273/239 |
| 2,819,904 | 1/1958 | Nelson et al. | 273/239 |
| 4,005,866 | 2/1977 | Marcil | 273/239 |
| 4,013,293 | 3/1977 | Hess et al. . | |
| 4,021,042 | 5/1977 | Sweeton | 273/239 |
| 4,034,980 | 7/1977 | Sniderman | 273/239 |
| 4,083,564 | 4/1978 | Matsumoto | 273/239 |
| 4,211,411 | 7/1980 | McDaniel et al. | 273/239 |
| 4,545,582 | 10/1985 | Andrews | 273/239 |
| 5,328,188 | 7/1994 | Brotz | 273/239 |

FOREIGN PATENT DOCUMENTS

| | | | |
|---|---|---|---|
| 1433603 | 2/1966 | France | 273/239 |

*Primary Examiner*—Mark S. Graham
*Attorney, Agent, or Firm*—Merchant, Gould, Smith, Edell, Welter & Schmidt, P.A.

[57] ABSTRACT

The present invention relates to a magnetic game comprising a game board having a playing surface with an array of first and second playing areas. The first playing area include at least one electro-magnet. A plurality of game pieces are adapted to be placed on the first or second playing areas and to flip in the air if the electro-magnet and the game piece magnet are of opposite polarity. Each game piece has a game piece magnet. The magnetic game further includes a light-emitting element positioned proximal the first playing area. The light-emitting element is configured to be in electrical communication with a power supply. A light-sensitive transducer is positioned proximal the second playing area. The light-sensitive transducer is configured to be placed in electrical communication with the power supply. The light-emitting element is illuminated when a shadow is cast over the light sensitive transducer.

15 Claims, 3 Drawing Sheets

ELECTRO-MAGNETIC GAME BOARD

TECHNICAL FIELD

This invention relates to a game apparatus having a large number of random factors and outcomes suitable for play between two or more players.

BACKGROUND

Games that are fun to play tend to have a certain combination of elements such as choice and visual effects. Choice is the ability of a player to choose the location on the game board to place his or her game piece, which creates a degree of randomness. For example, in the game of checkers the movement of a game piece by one player affects the movement of a game piece by another player. Neither player is able to determine with certainty the future move of his or her opponent. Attempting to determine the opponents next move provides challenge and fun.

One magnetic game apparatus modifies the game of checkers by increasing the element of randomness. The magnetic game apparatus increased randomness by incorporating permanent magnets into both the game pieces and the game board. When a player places the game piece on a playing area containing a magnet, a game piece may be projected or flipped across the game board as the close placement of magnets with opposite polarity creates repulsive forces. The additional randomness provided by the magnets makes the calculation of determining the opponents next move difficult and the game more challenging than the game of checkers. Such additional game enhancing elements are advantageous because the game becomes entertaining to all players.

This game is fun to play, but the magnets incorporated into its game pieces and game board are unable to switch polarity. Moreover, the design of the game piece limits the number of possible sides of the game piece viewed by the player when the game piece lands on the board. Yet another disadvantage is that play is generally limited to two players, which may cause eager participants to be excluded.

The present invention is advantageous because it increases the uncertainty and randomness provided by the earlier magnetic game boards. It also provides exciting visual effects that makes the game more attractive and more fun to play. The present invention is also advantageous because it can eliminate the need for a player to manually move his or her game pieces.

SUMMARY

The present invention relates to a magnetic game comprising a game board having a playing surface with an array of first and second playing areas. The first playing area include at least one electro-magnet. A plurality of game pieces are adapted to be placed on the first or second playing areas and to flip in the air if the electro-magnet and the game piece magnet are of opposite polarity. Each game piece has a game piece magnet.

The present invention also relates to a method of operating a magnetic game. The method comprises the steps of placing one or more game pieces on the first playing areas; and activating the electro-magnet thereby causing the game piece to be projected into the air if the polarity of the game piece magnet is oppositely disposed to the polarity of the energized electro-magnet.

DETAILED DESCRIPTION

Figure 1:
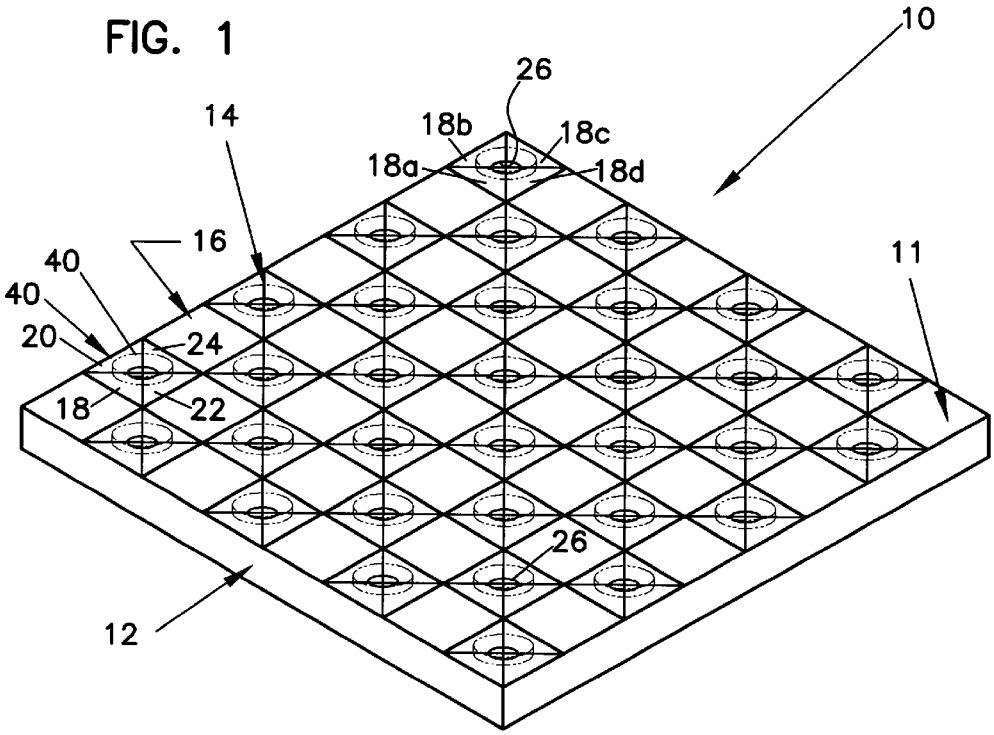
FIG. 1 is a perspective view of a game board and pieces.

A preferred embodiment of the present invention will be described in detail with reference to the drawing, wherein like reference numerals represent like parts and assemblies throughout the several views. Reference to the preferred embodiment does not limit the scope of the invention, which is limited only by the scope of the claims attached hereto.

In general terms the present invention relates to a game board and pieces that are similar to checkers, wherein both the game pieces and the playing portions of the board contain magnets. When a player sets a game piece on a playing area, the piece will either stay on the playing area or will be projected through the air, depending on the orientation of the poles on the magnets. Additionally, the game board is translucent and contains a combination of lights and light-sensitive transducers under the playing surface. When a playing piece is projected through the air, it will cause a shadow to be cast onto certain light sensitive transducers, which will cause some of the lights to illuminate. A brilliant display of lights and visual effects will result, which makes the game more attractive and fun to play. An earlier version of this game is described in U.S. Pat. No. 4,013,293, the disclosure of which is hereby incorporated by reference.

Figure 2:
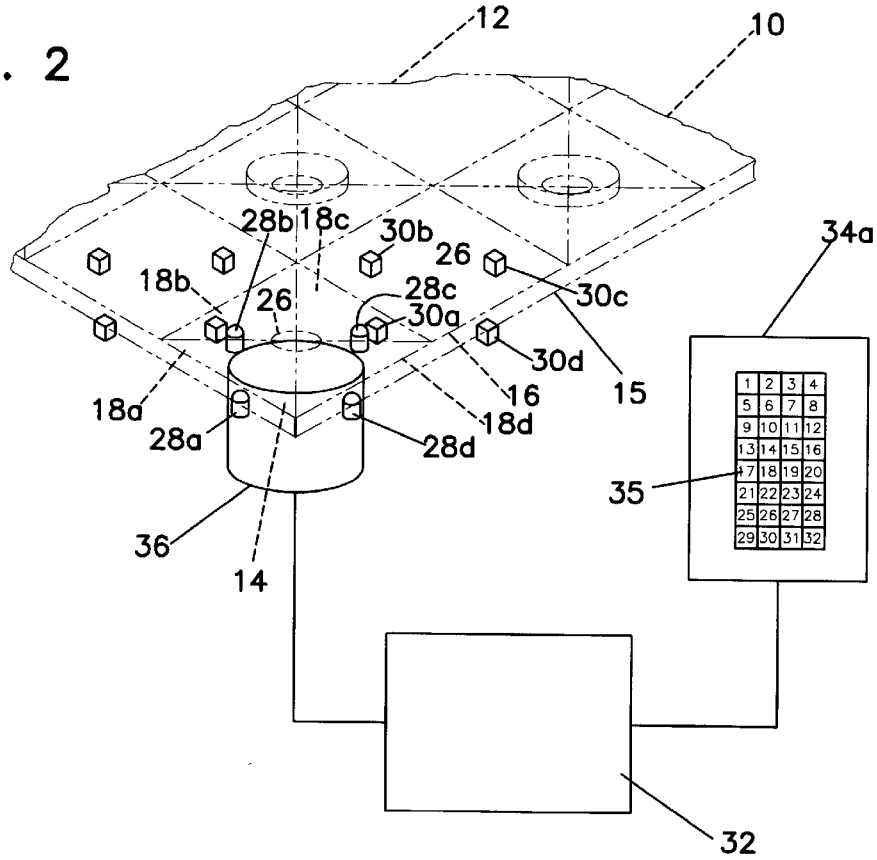
FIG. 2 is a partial perspective view of the game board shown in FIG. 1.

Referring to FIGS. 1 and 2, the game includes a game board 10, a relay board 32, electronic control units 34*a* and 34*b*, and a plurality of game pieces 40. The game board 10 further has a playing surface 12 that is partitioned into a plurality of playing squares 14 and spacing squares 16. The playing squares 14 and spacing squares 16 are oriented into rows and columns of alternating squares similar to a checkerboard or a chessboard. The game board 10 has sixty-four squares, thirty-two playing squares 14 and thirty-two spacing squares 16. However, one skilled in the art will recognize that the game board 10 can have any number of playing squares 14 and spacing squares 16.

The game board 10 is translucent so that light may shine through the board and create spectacular visual effects. The game board may also include reflective material, which will make the lights more flashy and heighten the visual effects. The reflective material may be decals or stickers that reflect brilliant images or lights. The decals or images might display one image or color when viewed from a different angle. The game pieces 40, which are described in more detail below can also include such stickers or decals.

Alternatively, just the playing squares 14 can be translucent, while the spacing squares 16 are opaque. In this alternative embodiment, however, there are small translucent areas that allow light to shine on photocells as described below.

Each playing square 14 is divided into four triangular areas 18*a*–18*d*. Each of the triangular areas 18*a*–18*d* has a base that corresponds to one side of the playing square 14. Additionally, each of the triangular areas 18*a*–18*d* has a different color, which helps to create a more spectacular visual effect when various lamps are illuminated. For example, the triangular areas 18*a*–18*d* can be blue, red, yellow, and green, respectively. The lamps are described in more detail below.

Figure 3:
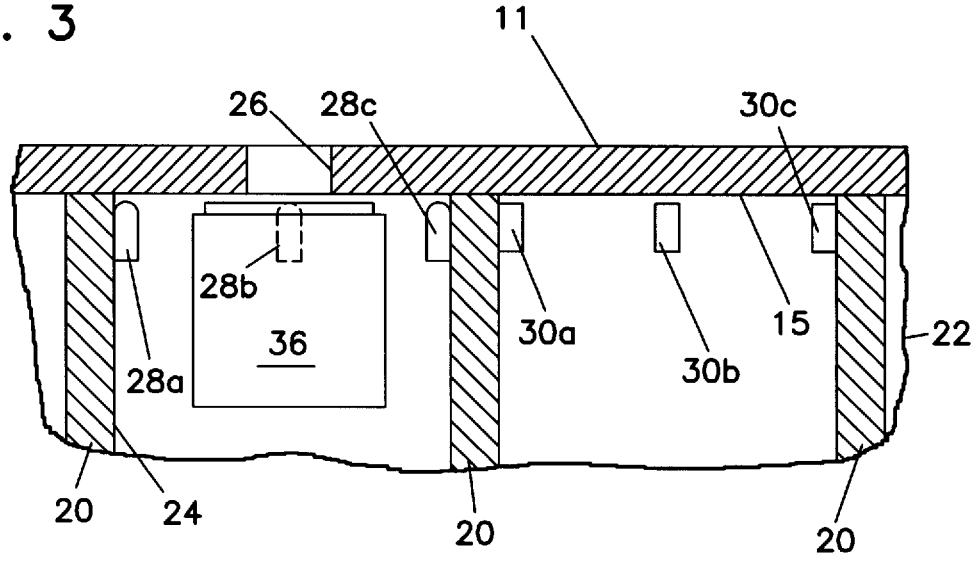
FIG. 3 is a partial cross-sectional view of the game board shown in FIGS. 1 and 2, taken along line 3—3.

Referring now to FIGS. 2 and 3, the game board 10 has a lower surface 15 in addition to the playing surface 12. A plurality of vertical dividers 20 and 22 extend along the lower surface 15. The vertical dividers 20 are perpendicular to the vertical dividers 22. In this configuration the vertical dividers 20 and 22 define a plurality of cavities 24. Each cavity is positioned directly underneath a playing square 14 or a spacing square 16.

An electro-magnet 36 is located within each cavity 28 that is underneath a playing square 14. Each electro-magnet 36 is attached to the lower surface 15. The game board 10 defines a plurality of holes 26 that extend between the playing and lower surfaces 12 and 15. Each playing square 14 has a hole 26, which helps to dissipate heat that is generated by the electro-magnet 36.

Additionally, there are four lamps 28*a*–28*d* located under each playing square 14 and positioned adjacent to the lower surface 15. Each lamp 28*a*–28*d* is located under a different triangular area 18*a*–18*d*, respectively, and is attached to one of the vertical dividers 20 or 22. There are also four light-sensitive transducers 30*a*–30*d* located under each spacing square 16 and attached to one of the vertical dividers 20 or 22. The area of the spacing square 16 that is directly above the light-sensitive transducers 30*a*–30*d* is completely translucent to maximize its sensitivity to ambient light and shadows. Alternatively, the entire spacing square can be completely translucent like glass or clear plastic.

The light-sensitive transducers can be a photocell such as a photoconductive cell or a phototransistor. Each light-sensitive transducer 30*a*–30*d* is positioned proximal to a mating lamp 28*a*–28*d* such that each light-sensitive transducer 30*a*–30*d* and its mating lamp 28*a*–28*d* is positioned on opposite sides of the vertical divider 20 or 22 to which they are attached.

Each lamp 28*a*–28*d*, mating light-sensitive transducer 30*a*–30*d*, and a power supply (not shown) are connected in series. When a shadow is cast over one of the light-sensitive transducers 30*a*–30*d*, the transducer 30*a*–30*d* will close the electrical circuit and the mating lamp 28*a*–28*d* will illuminate. As a result, the adjacent triangular area will light up. Referring to FIG. 2 for example, if a game piece is positioned on playing square 14, is flipped through the air, and causes a shadow to be cast over light sensitive transducer 30*a*, the lamp 28*c* will illuminate and the triangular area 18*c* will light up. In this configuration, the game board 10 will have spectacular visual effects during play. When a game piece 40 is set on a playing square 14 and is flipped through the air, the game piece 40 will cast a shadow on the playing surface 12 as it travels through the air, and the triangular areas 18*a*–18*d* underneath the shadow will illuminate, thereby tracking the path of the game piece 40.

Figure 4:
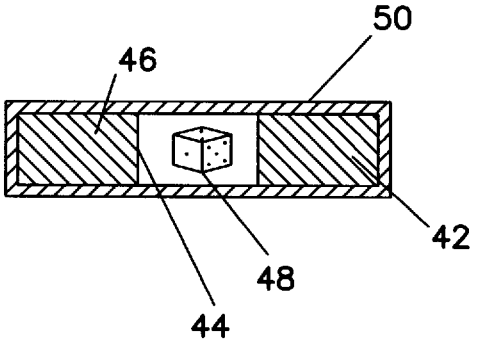
FIG. 4 is a cross-sectional view of a game piece.

Referring to FIG. 4, each game piece 40 contains a game piece magnet 42 or magnetic material. A coating or covering 50 covers the game piece magnet 42. The coating can be a reflective material, which will reflect the light from the lamps 28*a*–28*d* and increase the brilliance of the visual effects. The coating 50 and game piece magnet 42 is in the form of a disc having a diameter in the range of about 2 to 4 inches and a depth of about ½ to 1½ inches.

In one possible design for the game piece 40, the magnet 42 defines an aperture 44 in which a die 48 is located. A covering 50 surrounds both the magnet 42 and the die 48, which retains the die 48 in the aperture 44 and allows the die 48 to rotate within the aperture 44. The portion of the covering that is adjacent to the aperture 44 should be translucent so that the player can see the die. Additionally, light from the lamps 28*a*–28*d* will shine through the aperture 44, which will increase the brilliance of the visual effects. When the game piece 40 flips into the air, the die 48 rotates, and a particular face of the die 48 can be observed by the players when the game piece 40 lands. The player is never sure which face of the die 48 is going to appear when it lands.

The die can be numbered from 0 to 5 rather than from 1 to 6. Alternatively, the die 48 can have other images or indicia instead of numbers. This design creates an additional factor of randomness. One or more of the game pieces 40 can have a die 48.

As an alternative to having a die 48, the game piece 40 can have distinct faces or may have indicia. The indicia may indicate an amount of money won or lost. When the game piece 40 is flipped into the air, it is up to chance as to which surface or indicia of the game piece 40 will be exposed. A player may win points, money, a prize, or the opponent's game piece if a particular face is displayed.

Figure 5:
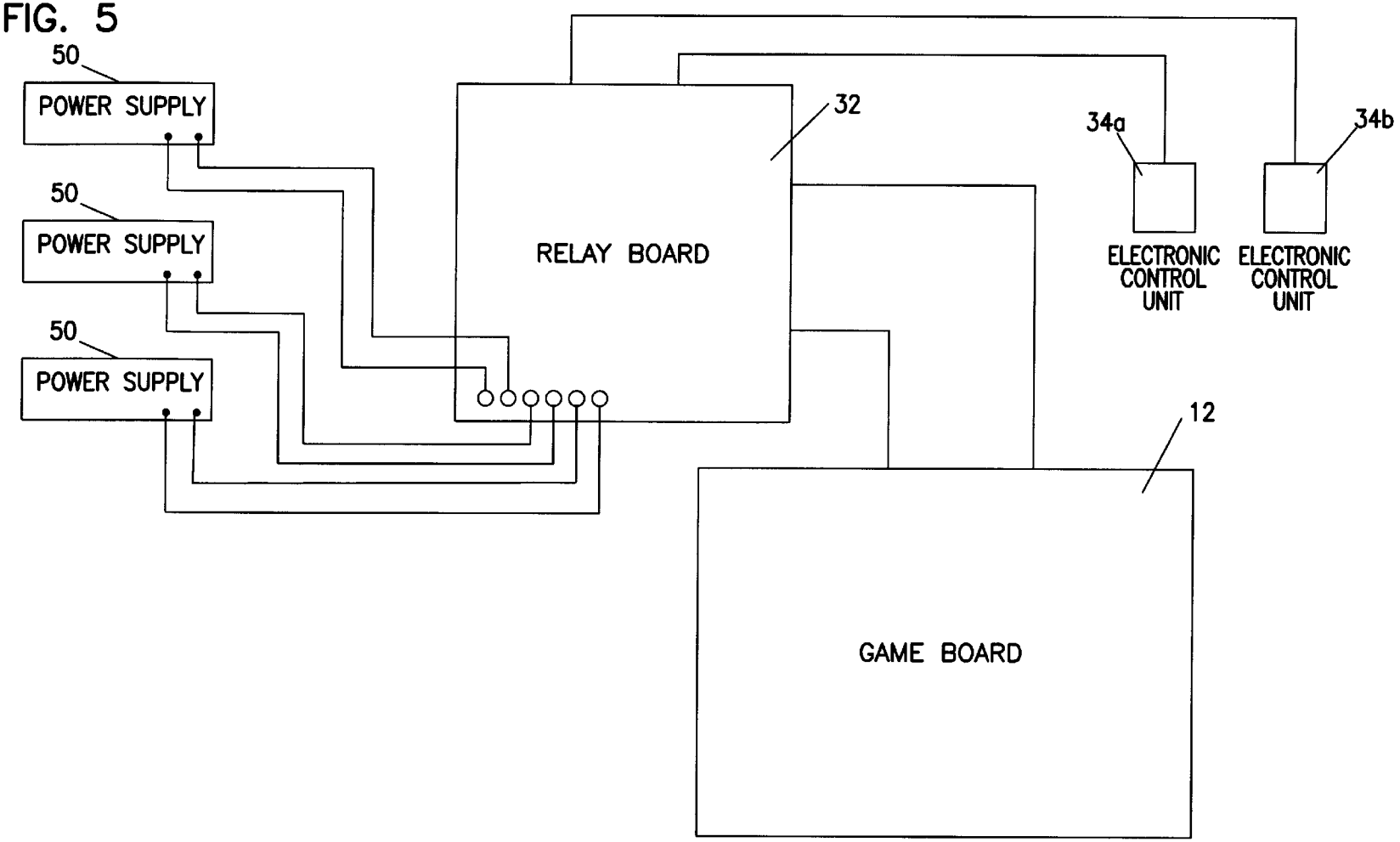
FIG. 5 is a functional block diagram of the control system for the game board shown in FIGS. 1, 2, and 3.

Referring now to FIG. 5, a relay board 32 is attached to a power supply 52, a pair of electronic control units 34*a* and 34*b*, and each of the electro-magnets 36 of the game board 10. The relay board 32 controls the polarity of the leads for each of the electro-magnets 36 so that each electro-magnet 36 will have a predetermined polarity when energized. In their normal state, all the electro-magnets 36 in a row have the same polarity. Additionally, the electro-magnets 36 in alternating rows have an alternating polarity.

Each of the electronic control units 34*a* and 34*b* has a keyboard 35 that contains thirty-two buttons, each button corresponding to one of the playing squares 14. Each button has a number printed on its face and the same number printed on its cooresponding playing square 14. In this configuration the player will know which button to push in order to flip a particular game piece 40. Although only two electronic control units 34*a* and 34*b* are shown, one skilled in the art will realize that there can be one electronic control unit for each player and that there can be more than two players and thus more than two electronic control units. Additionally, the electronic control units 34*a* and 34*b* can interface with the relay board 32 via remote control rather than wire.

The electro-magnets 36 are always energized during play. When a button on the keyboard 35 is pushed, it causes the electro-magnet 36 under the corresponding playing square 14 to be reversed, which causes the game piece to be flipped or projected through the air. When the player releases the button, the polarity of the electro-magnet 36 will return to its normal state. Randomness is provided by the flipping action of the game piece 40 because the players will not know whether the positive or negative pole of the game piece magnet 42 is oriented toward the playing surface 12 at any given time, and hence will not be able to accurately predict on which playing square 14 the game piece 40 will land.

While the invention has been described in conjunction with a specific embodiment thereof, it is evident that different alternatives, modifications, and variations will be apparent to those in the art in view of the foregoing description. Accordingly, the invention is not limited to these embodiments or the use of elements having specific configurations and shapes as presented herein.

The claimed invention is:

1. A magnetic game comprising:

a game board having a playing surface with an array of first and second playing areas organized into a checkerboard pattern, and a plurality of electro-magnets, at least one electro-magnet being positioned proximal to each of the first playing areas; and a plurality of game pieces, each game piece having a game piece magnet, wherein the game pieces are adapted to be placed on the first and second playing areas and to flip in the air if the electro-magnet and the game piece magnet are of opposite polarity.

2. The magnetic game of claim 1 further including:

a light-emitting element positioned proximal the first playing area, the light-emitting element configured to be in electrical communication with a power supply; and a light-sensitive transducer positioned proximal the second playing area, the light-sensitive transducer configured to be placed in electrical communication with the power supply, wherein the light-emitting element is illuminated when a shadow is cast over the light sensitive transducer.

3. The magnetic game of claim 1 further comprising a relay circuit in electrical communication with the plurality of electro-magnets, the relay circuit being configured to change the polarity of at least one of the electro-magnets.

4. The magnetic game of claim 3 further comprising an electronic control unit in electrical communication with the relay unit and the plurality of electro-magnets.

5. The magnetic game of claim 4 wherein the electronic control unit has a plurality of buttons, each electro-magnet corresponding to a different button, the electronic control unit configured to energize one of the electro-magnets when the electro-magnet's corresponding button is actuated.

6. The magnetic game of claim 1 wherein the playing surface is translucent and colored.

7. The magnetic game of claim 6 wherein each first playing area is divided into four regions.

8. The magnetic game of claim 7 wherein the playing surface is reflective.

9. The magnetic game of claim 8 wherein the playing surface is plastic.

10. The magnetic game of claim 1 wherein the first and second playing areas are squares oriented in a checker or chess board design.

11. The magnetic game of claim 2 wherein the light-emitting element is a fluorescent bulb.

12. The magnetic game of claim 2 wherein the light-sensitive transducer is a photoconductive cell.

13. The magnetic game of claim 1 wherein the game piece includes a magnet with a central aperture and a die positioned with the aperture.

14. The magnetic game of claim 13 wherein the game piece comprises a covering enclosing said game piece magnet and die.

15. The magnetic game of claim 1 wherein the game piece has a reflective material.

* * * * *